US005344142A

United States Patent [19]

Barreira

[11] Patent Number: 5,344,142

[45] Date of Patent: Sep. 6, 1994

[54] SIMULATED VOLLEYBALL GAME AND AIR BUBBLE SCORING SYSTEM

[76] Inventor: Jeane K. Barreira, 35D Middlesex Ave., Metuchen, N.J. 08840

[21] Appl. No.: 136,556

[22] Filed: Oct. 14, 1993

[51] Int. Cl.[5] ..... A63F 9/00

[52] U.S. Cl. ..... 273/85 F; 273/85 R; 273/319; 273/320; 273/321

[58] Field of Search ..... 273/85 R, 85 E, 85 F, 273/85 G, 85 H, 319–321, 331, 334, 335; 40/406–408; 340/323 R

[56] References Cited

U.S. PATENT DOCUMENTS

| | | | |
|---|---|---|---|
| 943,472 | 12/1909 | Schreiber et al. | 273/85 H |
| 3,706,149 | 12/1972 | Olivieri | 40/407 |
| 3,731,412 | 5/1973 | Winslow | 40/406 |
| 3,748,764 | 7/1973 | Schilter | 40/406 |
| 3,904,203 | 9/1975 | Matsumoto . | |
| 3,995,859 | 12/1976 | Goldfarb et al. | 273/85 F |
| 4,014,543 | 3/1977 | Arad | 273/85 H |
| 4,042,243 | 8/1977 | Hoel et al. . | |
| 4,047,717 | 9/1977 | DeAngelis | 273/85 F |
| 4,123,059 | 10/1978 | Guibas . | |
| 4,286,785 | 9/1981 | Todokoro . | |
| 4,334,682 | 6/1982 | Ham | 273/85 F |
| 4,826,160 | 5/1982 | Kobayashi | 273/447 |
| 4,872,679 | 10/1989 | Bohaski et al. | 273/85 R |
| 5,042,807 | 8/1991 | Sasakawa et al. | 273/85 E |

FOREIGN PATENT DOCUMENTS

| | | | |
|---|---|---|---|
| 1478251 | 2/1969 | Fed. Rep. of Germany | 273/85 H |
| 2622031 | 11/1977 | Fed. Rep. of Germany . | |
| 3527407 | 2/1986 | Fed. Rep. of Germany | 273/85 H |

*Primary Examiner*—Jessica J. Harrison
*Assistant Examiner*—Kerry Owens
*Attorney, Agent, or Firm*—Lerner, David, Littenberg, Krumholz & Mentlik

[57] ABSTRACT

A simulated volleyball game is disclosed. The game includes a game board having a playing surface with a center zone thereon. A tethered object is fixed to the center zone of the game board and is adapted to be propelled back and forth across the center zone. At least one simulated player is slidably mounted on tracks arranged at opposite sides of the playing surface and are adapted to catch or propel the tethered object upon propulsion of same across the center zone.

24 Claims, 4 Drawing Sheets

SIMULATED VOLLEYBALL GAME AND AIR BUBBLE SCORING SYSTEM

BACKGROUND OF THE INVENTION

The present invention relates to games where opposing players volley a tethered object back and forth, and to a scoring system. More particularly, the present invention relates to a simulated volleyball game wherein a tethered ball is propelled by air across an associated game board between two opposing players, and to a scoring system which may utilize air bubbles to show points.

The prior art discloses a number of action board games where two players compete for points by propelling an object back and forth across the board. Examples of such action games are disclosed in U.S. Pat. Nos. 4,286,785; 4,047,717 (FIGS. 22–28) and 3,995,859. The crowded nature of the prior art is indicative of the large demand in the toy market for action board games. Although several expedients and methods are employed to facilitate the play of these action games, none provide the features and advantages of the present invention.

The prior art also discloses a number of different scoring indicators for action board games. However, none provide a scoring system such as that provided in the present invention which, among other things, provides an air bubble scoring system wherein air bubbles are manually or automatically released into a liquid within a translucent container so that the score of a game, such as the simulated volleyball game of the present invention, can be constantly displayed during the pendency of the game.

The use of air as a means for propelling an object is a known expedient in many different arts. However, air has not been used in action board games as a propulsion means for propelling a tethered object between two opposing players. The present invention provides a simulated volleyball game which may use an air pump, manual or automatic, to propel a tethered object between two teams arranged on opposite sides of a game board. This same air pump, or an air line thereof, may also be used to control movement of game pieces along the game board. Still further, the air pump may be associated with the air bubble scoring system so that it can be used to operate both the play of the game and the scoring.

SUMMARY AND OBJECTS OF THE INVENTION

One aspect of the present invention pertains to a simulated volleyball game comprising a game board having a playing surface with a center zone thereon. A tethered object is fixed to the center zone of the game board and is adapted to be propelled across the center zone to opposing sides of the game board. A plurality of simulated players are slidably mounted on track means at opposite sides of the playing surface and are adapted for slidable movement across the width thereof. The simulated players are adapted to propel the tethered object across the center zone. The simulated volleyball game also comprises control means for causing slidable movement of the simulated players within the track means. The control means also include propulsion means associated with each of the simulated players for propelling the tethered object across the center zone toward an opposing side of the game board.

Preferably, the tethered object comprises a styrofoam ball and a string wherein the first end of a string is connected to the center zone of the game board and a second end of the string is connected to the styrofoam ball. The string is preferably of sufficient length to extend from the center zone to the ends of the game board where the slidable simulated players are mounted.

It is also preferable for the plurality of simulated players to comprise simulated frogs including a mouth portion, wherein the mouth portion is sized and shaped to catch the styrofoam ball as it is propelled across the game board.

In another preferred embodiment, an elongate net may be mounted to the game board at the center zone in a manner such that the net extends between the opposing teams of simulated players. This aspect of the present invention is preferable so that the game board may more closely emulate an actual volleyball court.

In yet another preferred embodiment, the propulsion means may comprise a plurality of tubes arranged within the plurality of opposing simulated players. The propulsion means may also comprise pressurized air means fluidly connected to the plurality of tubes for selectively providing a pressurized stream of air thereto. The pressurized stream of air may have sufficient pressure so that the tethered object will be propelled from an associated one of the simulated players toward the opposing side of the game board whereby at least one other simulated player is slidably mounted in the track means.

In yet another preferred embodiment, the pressurized air means may comprise at least one air pump whereby actuation of the at least one air pump causes the pressurized stream of air to be delivered to the simulated players.

In another embodiment of the present invention, the simulated volleyball game comprises scoring means for constantly displaying the score during playing of the game.

Preferably, the scoring means comprises an air actuated scoring mechanism and a display device. The display device may include a translucent container having a liquid therein and being fluidly connected to the air actuated scoring mechanism so that air bubbles are selectively released from the air actuated scoring mechanism to the translucent container. In another preferred embodiment, the scoring means may comprise an integrated circuit for processing the score of the game.

Preferably, the simulated volleyball game comprises shared air means for providing pressurized air from a common air source to the propulsion means and to the air actuated scoring mechanism so that the air bubbles are automatically released to the translucent container upon propulsion of the tethered object from an associated one of the simulated players.

In still another aspect of the present invention, an air bubble scoring system is provided for use with a game, wherein the air bubble scoring system includes at least one translucent container having a liquid therein and air pump means fluidly connected to the at least one translucent container for supplying pressurized air thereto. The air bubbles preferably indicate the score of the game by appearing in the translucent container upon actuation of the air pump means. According to this aspect of the present invention, the air bubble scoring system can be used in combination with many types of games having the need for such scoring system.

According to another aspect of the present invention, a method of playing a simulated volleyball game is provided wherein the method includes the steps of placing an object, such as a tethered styrofoam ball, in correspondence with the first game piece, such as a simulated frog. A pressurized stream of air is then supplied to the first game piece so that the object is propelled across the game board. A second game piece arranged on the opposite side of the game board is then moved so that same is placed beneath the path of the propelled object in an effort to prevent the object from striking the game board. As the object approaches the second game piece, a second pressurized stream of air is applied to the second game piece in an attempt to propel the object back across the game board toward the first side thereof. The steps of propelling the object are then repeated until the object strikes the game board. Preferably, the method also comprises the step of releasing at least one air bubble from an air supply to a liquid stored in an associated translucent container upon scoring of a point while playing the game.

Accordingly, it is an object of the present invention to provide a simulated volleyball game wherein a tethered object is propelled between two opposing teams.

It is another object of the present invention to provide a simulated volleyball game wherein air pressure is used to propel a tethered ball back and forth across a game board.

It is another object of the present invention to provide an air bubble scoring mechanism for use in connection with the simulated volleyball game wherein the air bubbles can be visually displayed in a translucent container filled with a liquid so that the score is constantly displayed during the pendency of the game.

It is yet another object of the present invention to provide an air bubble scoring mechanism which automatically indicates the score upon the happening of certain events during the pendency of the game.

It is yet another object of the present invention to provide an air bubble scoring mechanism which can independently be used with various games for visually displaying the score during the pendency of an associated game.

These and other objects, features and advantages of the present invention will be more clearly understood when read in conjunction with the detailed description and the accompanying drawings which follow.

DETAILED DESCRIPTION OF THE PREFERRED EMBODIMENT

Figure 1:
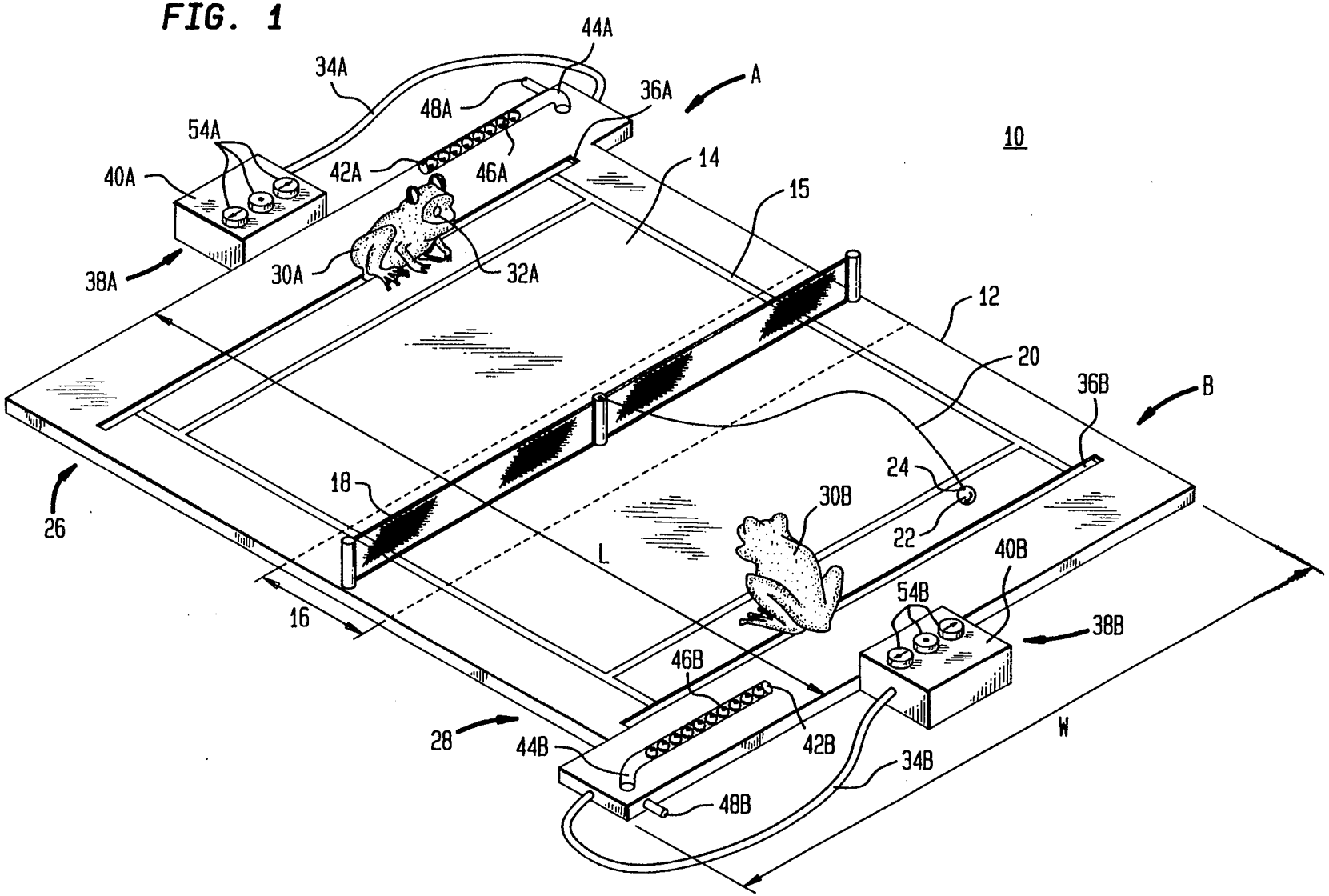
FIG. 1 is a perspective view of the simulated volleyball game of the present invention.
Figure 2:
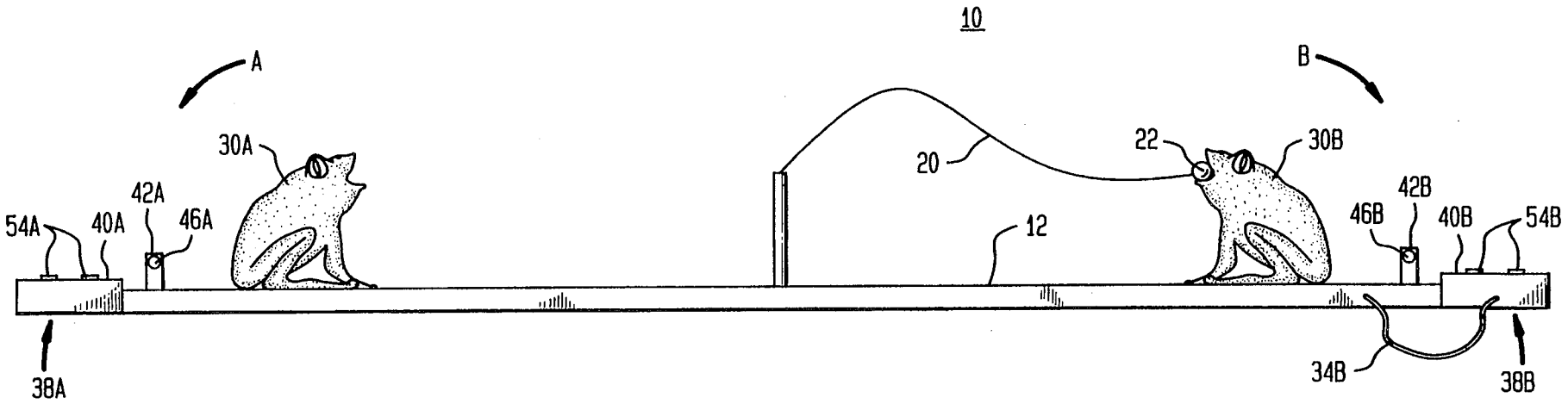
FIG. 2 is a side view of the embodiment shown in FIG. 1.

As shown in FIGS. 1–4, the simulated volleyball game 10 of the present invention is an action board game which can be played competitively by two players. While the preferred embodiment of the invention is directed to a simulated volleyball game, the present invention contemplates any type of action game which utilizes the inventive concepts discussed herein.

The preferred embodiment includes a game board 12 having a playing surface 14 thereon. The playing surface may have boundary lines 15 thereon to emulate a miniature volleyball court. These boundary lines merely serve an aesthetic function and may be displayed in proper proportion to the boundary lines of a real volleyball court. The game board 12 is preferably made of a somewhat rigid material such as stiff cardboard, plastic, wood, metal and the like, or it may be made of a foam material. It is important for the game board to have sufficient rigidity to support the required components shown in FIGS. 1–4, and discussed below, thereon.

The length L and width W of the game board 12 may also be selected so that the ratio thereof is consistent with the proper proportions of a regulation sized volleyball court. However, the ratio between the length L and the width W is not critical to the present invention, and thus, may be varied to accommodate various sized playing surfaces. In the embodiment shown in FIGS. 1–4, the game board 12 has a length L of about two feet and a width of about one and one half feet. The game board 12 also includes a center zone 16 which separates team A and team B on opposing sides of the playing surface 14.

Optionally, a net 18 may be centrally mounted in the center zone 16 to extend across the width W of the game board 12. In a preferred embodiment, the net 18 may extend approximately three inches above the playing surface 14. However, the height of the net 18 is not critical so long as it does not interfere with the projectile path of the associated ball as discussed below.

The simulated volleyball game 10 may also include a string 20 having a first end fixed to the center of the game board 12. A second end of the string 20 is attached to a styrofoam ball 22 at connection point 24. Preferably, the string 20 has a length equal to approximately one half of the length L, approximately one foot in the embodiments shown in FIGS. 1–4, so that the styrofoam ball 22 can be propelled back and forth over the center zone 16 between ends 26 and 28 of the game board 12. For reference purposes, end 26 will be considered end A which is associated with team A and end 28 will be considered end B which is associated with team B.

Team A may comprise a single frog 30A (a first simulated player) and team B may comprise a single frog 30B (a second simulated player). However, in alternate embodiments, teams A and B may comprise a plurality of frogs. Of course, alternate embodiments may also include various shaped "simulated players" such as other types of animals, people, and inanimate objects.

Figure 3:
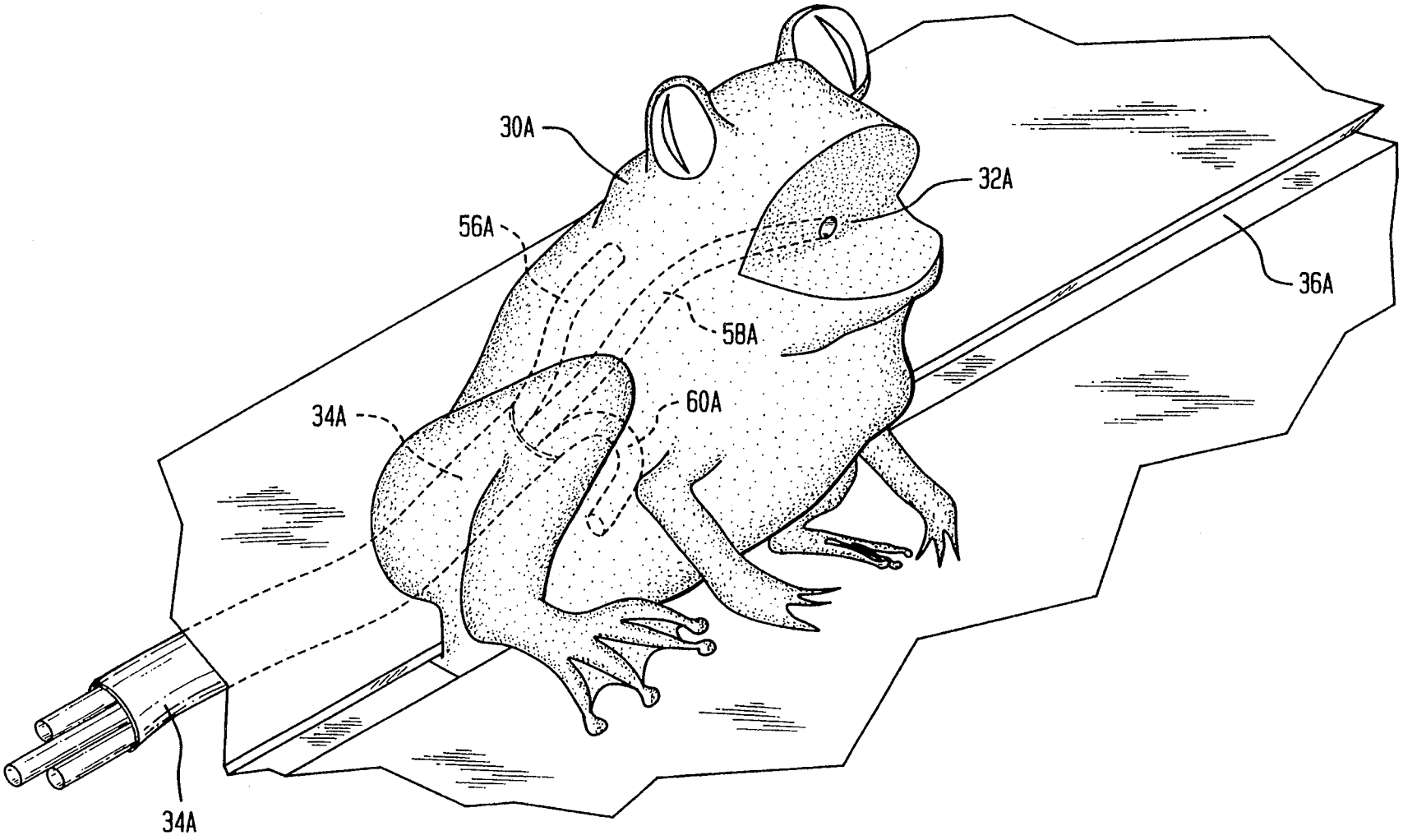
FIG. 3 is a broken-away view illustrating the relationship between the air tubes and a simulated frog of the present invention.

For reasons that will be more apparent when discussed below, each of the frogs 30A and 30B may include a mouth 32A and 32B which is sufficiently sized and shaped to receive the styrofoam ball 22 therein. As best shown in FIG. 3, air tubes 34A and 34B (shown partially in phantom) enter the body of the frogs 30A and 30B and may comprise three smaller diameter air tubes 56–60 (shown partially in phantom) which are operatively associated with the open mouth 32A and 32B and the hollow body of the frogs 30A and 30B for reasons that will be more apparent when discussed below.

Figure 4:
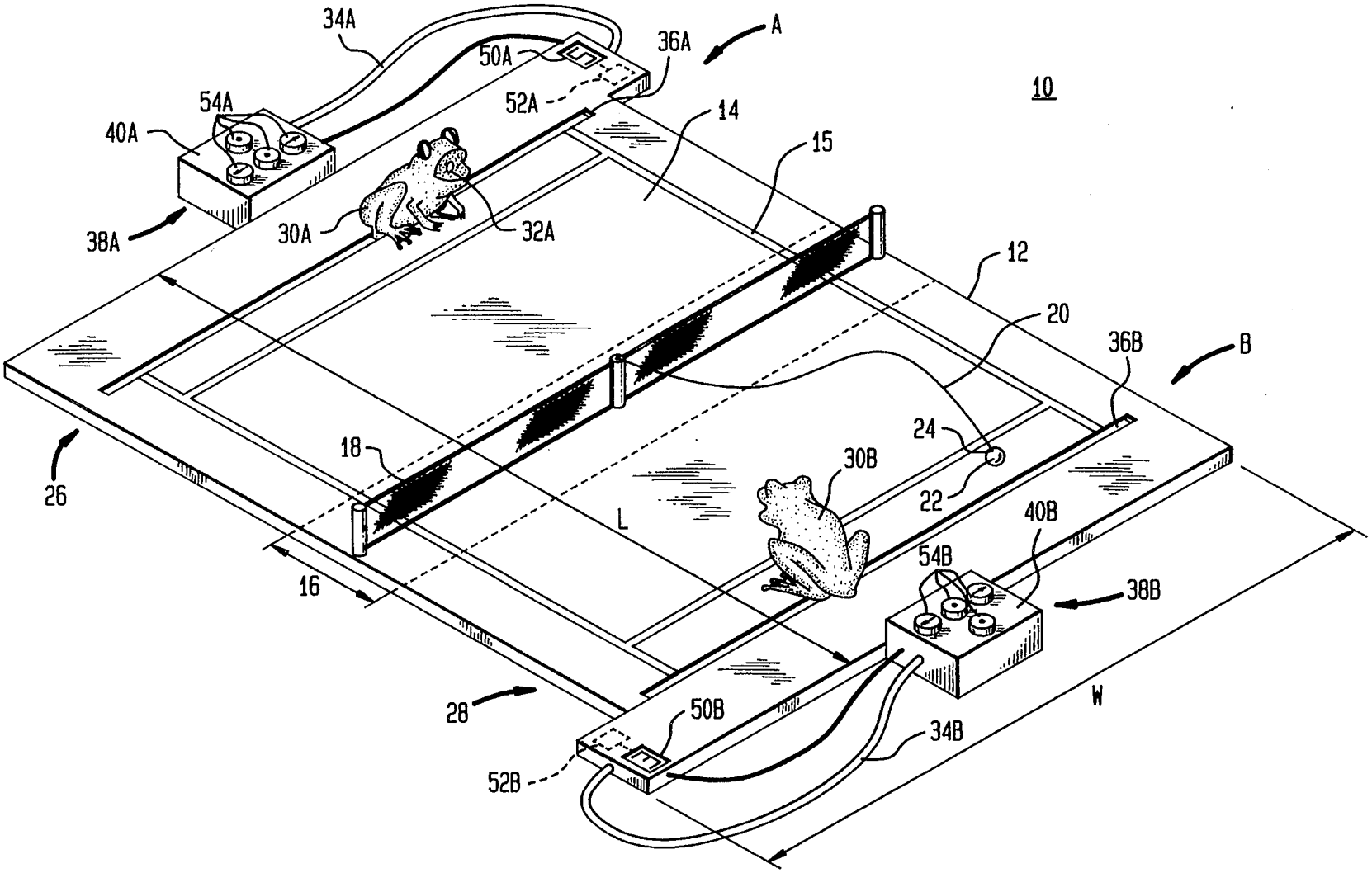
FIG. 4 is a perspective view of an additional embodiment of the present invention.

The frogs 30A and 30B are slidably mounted in tracks 36A and 36B at ends 26 and 28, respectively. As shown in FIGS. 1 and 4, the tracks 36A and 36B extend substantially the entire width W of the game board 12 so that the associated frogs 30A and 30B can cover the entire width of the playing surface 14. Alternatively, the tracks may be arranged to form an arcuate path. This embodiment may be desirable to achieve a precise corresponding distance between the length of the string 20 with the styrofoam ball 22 thereon, and each point along the arcuate shaped tracks (not shown) on which the frogs are mounted.

In another preferred embodiment, the frogs 30A and 30B may be freely movable about their respective sides of the game board 12. In this embodiment, there is no need for any type of guidance track and thus, alignment of the frogs beneath the styrofoam ball 22 depends solely on the skill of the players.

A plurality of air pumps 38A and 38B are connected to respective air tubes 34A and 34B. The air pumps 38A and 38B may be actuated by pump control pads 40A and 40B. The air pumps can be energized pumps actuatable by electronic or other means of automatically releasing air, or can be arranged for delivery of air following manual operation of a switch, trigger, pad, etc.

The simulated volleyball game 10 also includes a novel constant display scoring system. In this regard, several different scoring systems may be used in combination with the simulated volleyball game 10. One particularly preferred scoring system is an air bubble scoring system and display which comprises a pair of translucent containers 42A and 42B, wherein each of the containers is associated with its respective team. Containers 42A and 42B are filled with a liquid 44A and 44B. Air bubbles, generally indicated by 46A and 46B, are adapted to be released within the liquid 44A and 44B of the respective containers 42A and 42B to provide a visual display of the current score of the simulated volleyball game. Thus, the air bubbles 46A and 46B are intended to represent points scored during the game.

Bubble release pins 48A and 48B are operatively associated with each of the respective containers 42A and 42B in a manner so that actuation of the respective bubble release pins will release one air bubble at a time into the container. The bubble release pins 48A and 48B are disposed between the liquid 44A and 44B and an air chamber associated with the air pumps 38A and 38B. The present invention also contemplates an automatic bubble release feature wherein one air bubble may be automatically released into an associated container 42A or 42B each time one of the players scores a point. In this embodiment it may be unnecessary to include the bubble release pins 48A and 48B.

The containers 42A and 42B may extend either vertically upward from the playing surface 14 or may extend horizontally along the playing surface 14. Despite the orientation of the containers 42A and 42B, it is important for the air bubbles 46A and 46B therein to be fully visible during pendency of the game.

In the embodiment of FIG. 4, the simulated volleyball game 10 includes an alternative type of scoring system. More particularly, the scoring system of the embodiment shown in FIG. 4 includes score display screens 50A and 50B which are adapted to be automatically or manually operated. In the case of automatic operation, integrated electronic circuits, shown in phantom and in block format as reference numerals 52A and 52B, are electronically connected to the display screens 50A and 50B. The orientation and arrangement of the display screens 50A and 50B are not particularly critical so long as they are clearly visible to players of the simulated volleyball game 10.

In operation, the simulated volleyball game 10 is adapted to be played by two players. The rules of the game are much like the rules of volleyball in that one of the teams, such as team A, begins play by serving the tethered styrofoam ball 22 over the net 18 to team B. More particularly, the styrofoam ball 22 is initially placed in the mouth 32A of frog 30A. An appropriate button 54A on the pump control pad 40A is then depressed, thereby actuating the air pump 38A so that a pressurized stream of air is transported through air tube 34A and into the mouth 32A of the frog 30A. The pressurized stream of air is of sufficient force to propel the styrofoam ball 22 over the net 18 toward the end 28 of the game board 12. If the ball 22 should strike the playing surface 14, team A will be awarded one point.

After the styrofoam ball 22 is served, team B may slide frog 30B along the track 36B in an effort to catch the styrofoam ball 22 in its mouth 32B before the ball 22 strikes the playing surface 14. Assuming that the ball 22 is caught in the mouth 32B of frog 30B, the team B player should then depress the pump control pad 40B, which will cause the styrofoam ball 22 to be propelled back over the net 18 toward the end 28. Alternatively, frog 30B may attempt to propel the ball 22 back across the net 18 before the ball is caught. Thus, as the players' timing skill improves, the control pad will be depressed immediately before the frog catches the ball.

Team A will then try to prevent the ball 22 from striking the playing surface 14. As discussed above, this may be accomplished by either propelling the ball 22 back over the net 18 before the ball is caught or by first catching the ball 22 in the mouth 32A of frog 30A and subsequently propelling same over the net 22. If team A is not successful at preventing the styrofoam ball 22 from striking the playing surface 14, team B will have won the volley and will have the opportunity to begin service. As is the case in regulation volleyball, team B will not receive a point for winning such volley because it did not serve the ball 22.

Each volley will continue until one team is successful at causing the other team to miss the styrofoam ball 22. As discussed above, if the successful team had served the ball 22, that team will be awarded one point for winning the volley. If the scoring system associated with the simulated volleyball game 10 is the air bubble scoring system, each time a team scores a point, the respective bubble release pin 48A or 48B should be depressed or pulled so that one air bubble will be released into the liquid 44A or 44B of an associated container 42A or 42B. By proceeding in this manner, the score of the game will be clearly displayed at all times.

The game may be played to fifteen points, as is the case in regulation volleyball. However, if the players should so choose, the game may be played to any number of points.

If the automatic scoring system embodiment is used in connection with the simulated volleyball game 10, the score will automatically be advanced each time one of the teams successfully scores a point. Alternatively, a manual scoring system may be employed wherein the display screen 50A or 50B will indicate the present score of the game only after one of the players manually advances the score display.

It should be appreciated that if the automatic bubble release feature is used, the rules of the game may be different than those discussed above. For example, a player may automatically be awarded one point each time one of the buttons 54A or 54B is depressed so that the respective pump control pad 40A or 40B is actuated to propel the ball 22 across the net 18.

In another preferred embodiment, each of the tracks 36A and 36B include five equidistant preselected positions (not shown) arranged along the entire width W thereof. Each of the five preselected positions are operatively associated with the tracks 36A and 36B and the respective air pumps 38A and 38B so that actuation of the associated pump control pads 40A and 40B will cause the frogs 30A and 30B to slide along their respective tracks until they reach one of the preselected positions. At that time, slidable movement of the frogs 30A or 30B will cease until the appropriate actuation button on the pump control pad is again depressed. Thus, in this preferred embodiment, the frogs 30A and 30B are adapted to slide between adjacent ones of the five preselected positions. The preselected positions are intended to emulate various positions on a volleyball court. As the players' coordination improves, the frogs 30A and 30B may be more rapidly moved between adjacent preselected positions. As shown in FIGS. 1 and 4, the pump control pads 40A and 40B include separate buttons 54A and 54B with indicia thereon to indicate the function of such buttons. More particularly, depression of the button with an arrow pointing to the left, will cause one of the frogs to slide to the left. Similarly, depression of the button with an arrow pointing to the right will cause the associated frog to slide to the right. When a player desires to propel the ball 22 over the net 18, the centrally arranged button displaying a circle thereon should be depressed. Of course, the indicia on the buttons B of the pump control pad may vary depending on the number of functions and the aesthetic appearance desired. Optionally, a fourth button (not shown) may be added to the pump control pads 40A and 40B. The fourth button could be used in lieu of the bubble release pins 48A and 48B for advancing air bubbles to a respective container 42A and 42B.

As discussed above, movement of the frogs 30A and 30B may be accomplished by depressing the appropriate button 54A and 54B. As illustrated in FIG. 3, each of the frogs adapted to receive a respective air tube 34A or 34B. Preferably, one of the air tubes 34A or 34B enters the body of the frog 30A or 30B near the base portion thereof. Once inside the hollow cavity of the respective frog's body, the air tubes 34A and 34B may branch out to form three separate air flow paths 56, 58 and 60. In an alternate embodiment, three separate valves (not shown), or alternatively one three-way valve (not shown), are arranged within the frog's 30A and 30B body at the point where the air flow tubes 34A and 34B branch out to form three separate air flow paths. The valves are normally arranged in a closed position and are operatively related to the buttons 54A and 54B so that depression of any one of the buttons will control the respective valve to open selected one of the air flow paths. Thus, slidable movement of the frogs 30A and 30B and the propulsion of the ball 22 is effectively controlled by depression of the buttons 54A and 54B.

In an alternate preferred embodiment, movement of the frogs 30A and 30B may be manually controlled by a player placing his or her hand directly on the frog and sliding it to the desired position. Still further, a handle (not shown) may be attached to the back of the respective frogs 30A and 30B, in the manual movement embodiment, so that the frogs can be easily controlled by the players.

In another alternate embodiment, a shared air feature may be arranged so that depression of either "arrow" button will also cause a pressurized stream of air to be delivered to a frog's mouth. Still further, in another alternate embodiment, the shared air feature may also control delivery of air bubbles to an associated air bubble scoring system.

While the foregoing description and figures are directed toward the preferred embodiments in accordance with the present invention, it should be appreciated that numerous modifications can be made to each of the components of the simulated volleyball game 10 as discussed above. Indeed, such modifications are encouraged to be made in the materials, structure and arrangement of the disclosed embodiments of the present invention, as well as the steps of playing the game, without departing from the spirit and scope of same. Thus, the foregoing description of the preferred embodiments should be taken by way of illustration rather than by way of limitation, as the scope of the present invention is defined by the claims set forth below.

What is claimed is:

1. A simulated volleyball game comprising:

a game board having a playing surface with a center zone thereon and having a predetermined width and a predetermined length, said predetermined length including opposing first and second sides;

a tethered object fixed to said game board within said center zone and being adapted for projected movement thereacross;

a plurality of simulated players arranged on said playing surface for movement thereabout, said plurality of simulated players being adapted to propel said tethered object across said center zone;

propulsion means associated with each of said simulated players for propelling said tethered object across said center zone toward one of said opposing first and second sides; and scoring means for constantly displaying the score, said scoring means including at least one pneumatic scoring mechanism and a display device, said display device including a translucent container having a liquid therein and being fluidly connected to said pneumatic scoring mechanism so that a preselected number of air bubbles are selectively released from said at least one pneumatic scoring mechanism to said translucent container.

2. The simulated volleyball game of claim 1 further comprising track means arranged at said opposing first and second sides for providing a movement path parallel to said predetermined width, said plurality of simulated players being slidably mounted on said track means for slidable movement therealong.

3. The simulated volleyball game of claim 2 wherein said track means includes a plurality of preselected positions, said plurality of simulated players being adapted for selective and slidable movement between each of said preselected positions along said track means.

4. The simulated volleyball game of claim 1 further comprising control means for controlling said movement of said simulated players about said playing surface.

5. The simulated volleyball game of claim 4 wherein said control means comprises pressurized air means fluidly connected to said plurality of simulated players for selectively causing said movement of said simulated players.

6. The simulated volleyball game of claim 1 wherein said tethered object comprises a styrofoam ball and a string, said string having a first end connected to said game board and a second end connected to said styrofoam ball.

7. The simulated volleyball game of claim 1 wherein said plurality of simulated players comprises simulated frogs, said simulated frogs including a mouth portion, said mouth portion being sized and shaped to catch said tethered object therein as said tethered object is propelled across said game board.

8. The simulated volleyball game of claim 7 wherein said plurality of simulated frogs comprise a pair of frogs.

9. The simulated volleyball game of claim 1 further comprising an elongate net mounted to said game board at said center zone and extending generally transverse to said predetermined length so that said tethered object can be propelled over said elongate net.

10. The simulated volleyball game of claim 1 wherein said propulsion means comprises at least one tube arranged within each of said simulated players, and pressurized air means fluidly connected to said plurality of tubes for selectively providing a pressurized stream of air thereto, said pressurized stream of air being of sufficient pressure so that said tethered object will be propelled from an associated one of said simulated players toward said opposing side.

11. The simulated volleyball game of claim 10 wherein said pressurized air means comprises at least one air pump whereby actuation of said at least one air pump causes said pressurized stream of air to be delivered to said simulated players.

12. The simulated volleyball game of claim 1 wherein said scoring means comprises integrated circuit means for advancing the score of said game.

13. A simulated volleyball game comprising:

a game board having a playing surface with a center zone thereon and having a predetermined width and a predetermined length, set predetermined length including opposing first and second sides;

a tethered object fixed to said game board within said center zone and being adapted for projected movement thereacross;

track means for providing a movement path parallel to said predetermined width, said track means arranged at said opposing first and second sides;

a plurality of simulated players slidably mounted on said track means at said opposing first and second sides for slidable movement therealong, said plurality of simulated players being adapted to propel said tethered object across said center zone;

control means for controlling said slidable movement of said simulated players;

propulsion means associated with each of said simulated players for propelling said tethered object across said center zone toward one of said opposing first and second sides, said propulsion means comprising at least one tube arranged within said plurality of opposing simulated players and pressurized air means fluidly connected to said at least one tube for selectively providing a pressurized stream of air thereto, said pressurized stream of air being of sufficient pressure so that said tethered object will be propelled from an associated one of said simulated players towards said opposing side, said pressurized air means comprising at least one air pump whereby actuation of said at least one air pump causes said pressurized stream of air to be delivered to said simulated players;

scoring means for constantly displaying the score of said game, said scoring means including at least one pneumatic scoring mechanism and at least one display device, said at least one display device including a translucent container having a liquid therein and being fluidly connected to said at least one pneumatic scoring mechanism so that a preselected number of air bubbles are selectively released from said pneumatic scoring mechanism to said translucent container; and shared air means for simultaneously providing pressurized air to said propulsion means and to said pneumatic scoring mechanism so that said air bubbles are released to said translucent container upon propulsion of said tethered object from an associated one of said simulated players.

14. The simulated volleyball game of claim 13 wherein said scoring means comprises integrated circuit means for automatically displaying the score of said game.

15. The simulated volleyball game of claim 13 wherein said plurality of simulated players comprise simulated frogs, said simulated frogs including a mouth portion, said mouth portion being sized and shaped to catch said tethered object therein as said tethered object is projected across said game board.

16. The simulated volleyball game of claim 13 wherein said tethered object comprises a styrofoam ball and a string, said string having a first end connected to said game board and a second end connected to said styrofoam ball.

17. The simulated volleyball game of claim 13 wherein said pressurized air means comprises at least one air pump, whereby actuation of said at least one air pump is adapted to control said slidable movement of said simulated players.

18. An air bubble scoring system in combination with a game, said air bubble scoring system comprising:

at least one translucent container having a liquid therein; and air pump means fluidly connected to said at least one translucent container for supplying pressurized air thereto, whereby a preselected number of air bubbles are formed in said at least one translucent container upon actuation of said air pump means to continuously indicate the score of said game.

19. The air bubble scoring system of claim 18 wherein said at least one translucent container comprises a pair of translucent containers.

20. The air bubble scoring system of claim 18 wherein said game associated therewith includes at least one movable game piece, said air pump means being adapted to effectuate movement of said at least one game piece.

21. The air bubble scoring system of claim 20 wherein said game further includes a projectable object, said air pump means being adapted to provide a pressurized stream of air to said at least one game piece of sufficient force to propel said object away from said at least one game piece.

22. The air bubble scoring system of claim 18 further comprising pin means arranged between said air pump means and said translucent container for controlling formation of said air bubbles in said translucent container.

23. A method of playing a simulated volley ball game comprising the steps of:

placing an object in correspondence with a first game piece on a first side of a game board;

supplying a first pressurized stream of air to said first game piece so that said object is propelled across said game board toward a second side thereof;

moving a second game piece on said second side of said game board so that said second game piece is placed beneath said object in an attempt to prevent said object from striking the surface of said game board;

supplying a second pressurized stream of air to said second game piece as said object approached said second game piece in an attempt to propel said object back to said first side of said game board; and repeating said steps of propelling said object until said object strikes said game board.

24. The method of claim 23 further comprising the step of releasing at least one air bubble from an air supply into a liquid stored in an associated translucent container upon scoring of a point while playing said game.

* * * * *